US009770111B2

(12) United States Patent
Johnson et al.

(10) Patent No.: US 9,770,111 B2
(45) Date of Patent: Sep. 26, 2017

(54) HEIGHT ADJUSTING MECHANISM AND STOOL FOR DENTAL PRACTITIONER

(71) Applicant: A-dec, Inc., Newberg, OR (US)

(72) Inventors: Kohler Johnson, Dundee, OR (US); Brian E. Bonn, Portland, OR (US)

(73) Assignee: A-dec, Inc., Newberg, OR (US)

( * ) Notice: Subject to any disclaimer, the term of this patent is extended or adjusted under 35 U.S.C. 154(b) by 70 days.

(21) Appl. No.: 14/639,932

(22) Filed: Mar. 5, 2015

(65) Prior Publication Data

US 2016/0255959 A1 Sep. 8, 2016

(51) Int. Cl.

| | |
|---|---|
| ***A47C 7/40*** | (2006.01) |
| ***A47C 7/50*** | (2006.01) |
| ***A47C 9/00*** | (2006.01) |
| ***A47C 1/03*** | (2006.01) |
| ***A47C 7/00*** | (2006.01) |

(52) U.S. Cl.

CPC ..... *A47C 7/402* (2013.01); *A47C 1/03* (2013.01); *A47C 7/006* (2013.01); *A47C 7/506* (2013.01); *A47C 9/005* (2013.01)

(58) Field of Classification Search

CPC ..... A47C 7/402; A47C 1/03; A47C 7/006; A47C 7/506; A47C 9/005

USPC ..... 297/353, 411.36, 352, 383; 248/409, 248/408, 423, 118.3, 125.8, 407

See application file for complete search history.

(56) References Cited

U.S. PATENT DOCUMENTS

| | | | | |
|---|---|---|---|---|
| 2,568,988 | A * | 9/1951 | Childs | A61B 90/60 297/344.18 |
| 4,221,430 | A | 9/1980 | Frobose | |
| 4,573,737 | A | 3/1986 | Korn | |
| 4,607,882 | A * | 8/1986 | Opsvik | A47C 9/002 297/195.11 |
| 5,007,678 | A | 4/1991 | DeKraker | |
| 5,551,754 | A | 9/1996 | Neumueller | |
| 5,582,460 | A | 12/1996 | Schultz | |
| 5,882,077 | A | 3/1999 | Gebhard | |
| 5,884,969 | A | 3/1999 | Gebhard | |
| 5,997,093 | A * | 12/1999 | Gollin | A47C 1/03 297/353 |
| 6,315,362 | B1 | 11/2001 | Chuang | |
| 6,957,867 | B1 * | 10/2005 | Su | A47C 1/03 297/353 |

(Continued)

FOREIGN PATENT DOCUMENTS

| | | | | |
|---|---|---|---|---|
| CH | DE 29718123 U1 * | 12/1997 | ..... | A47C 7/402 |
| FR | EP 2005861 A1 * | 12/2008 | ..... | A47C 7/402 |

*Primary Examiner* — Milton Nelson, Jr.

(74) *Attorney, Agent, or Firm* — Klarquist Sparkman, LLP

(57) ABSTRACT

A height adjusting mechanism for a dentistry stool comprises a support member, a movable height adjusting assembly and a pushbutton actuator. The support member is coupleable to the stool adjacent a seat of the stool. The movable height adjusting assembly is selectively movable up and down relative to the support member. The pushbutton actuator is positionable on a side of the movable height adjusting assembly adjacent a seated user, and is manually actuatable by the seated user to release the movable height adjusting assembly from a locked position at a current height to allow the movable height adjusting assembly to be moved to a new height. The height adjusting mechanism can be implemented to provide a height-adjustable seat back and/or a height-adjustable torso bar.

13 Claims, 9 Drawing Sheets

(56) References Cited

U.S. PATENT DOCUMENTS

| | | | | |
|---|---|---|---|---|
| 9,084,486 | B1 * | 7/2015 | Richardson | A47C 15/004 |
| 2007/0236057 | A1 * | 10/2007 | Smith | A47C 1/143<br>297/183.2 |
| 2009/0184560 | A1 * | 7/2009 | Tsai | A47C 1/03<br>297/411.36 |
| 2010/0038947 | A1 * | 2/2010 | Sanchez | A47C 7/402<br>297/354.12 |
| 2011/0175415 | A1 * | 7/2011 | Baumann | A47C 7/402<br>297/353 |

* cited by examiner

HEIGHT ADJUSTING MECHANISM AND STOOL FOR DENTAL PRACTITIONER

BACKGROUND

Dental practitioners typically practice from a seated position in which they lean forwardly to access the patient, and in particular, the patient's oral cavity. In addition to providing adequate support, dental operatories and other dental work spaces are often confined, so seating for practitioners needs to have a small form factor and be highly mobile. Moreover, stools or other seating for practitioners needs to allow easy ingress and egress, particularly because a practitioner attending to multiple patients in several different operatories concurrently throughout an entire day may enter and exit a seated position 100 times or more. Further, practitioners range in sizes, practice styles and preferences, so any seating solution useful to a practice with multiple practitioners needs to allow for a range of adjustment that can be performed simply and quickly.

SUMMARY

Described below are embodiments of a height adjusting mechanism and an associated practitioner's stool that address some of the drawbacks of conventional seating for practitioners.

According to a first implementation, a height adjusting mechanism for a dentistry stool comprises a support member, a movable height adjusting assembly and a pushbutton actuator. The height adjusting mechanism can be implemented to provide a height-adjustable seat back and/or a height-adjustable torso bar. The movable height adjusting assembly is selectively movable up and down relative to the support member. The pushbutton actuator is positionable on a side of the movable height adjusting assembly adjacent a seated user, and is manually actuatable by the seated user to release the movable height adjusting assembly from a locked position at a current height to allow the movable height adjusting assembly to be moved to a new height.

In some implementations, the height adjusting mechanism includes a seat back coupled to a distal end of the movable height adjusting assembly. In some implementations, the support member includes at least one guide groove and the movable height adjusting assembly includes at least one guide member configured to fit within the at least one guide groove.

In some implementations, the movable height adjusting assembly comprises a rear cover and a front cover, and the front and rear covers substantially enclose an engaged portion of the support member. The rear cover can have a U-shaped cross section, and the front cover can be configured to fit within and complete the U-shaped cross section. The rear cover can have an inner surface with protruding guide members configured to engage corresponding guide grooves in the support member. The assembly can include a lower cover with an opening shaped to receive the support member, the lower cover being configured for positioning at a junction of the rear cover and the front cover adjacent their proximal ends.

In some implementations, the front cover and the rear cover fit together to surround the support member, and the front cover and the rear cover having smooth outer surfaces to enhance the aesthetic appearance and to facilitate cleaning.

In some implementations, the front cover includes a cutout shaped to receive the pushbutton actuator, and the assembly includes a biased engagement member coupled to its inner surface. The pushbutton actuator can be depressible to contact the engagement member and urge it out of engagement with the support member to permit the movable height adjusting assembly to be moved relative to the support member. In some implementations, the biased engagement member is coupled to the rear cover. The support member can have a series of spaced recesses, and the engagement member can be biased to contact one of the recesses. In some implementations, there is a plate configured to be coupled to the rear cover with the support member positioned between the plate and the rear cover.

In some implementations, the support member has an angled proximal end with apertures, and the angled proximal end is configured for coupling the support member rearward of a seat of the stool.

In some implementations, the pushbutton actuator is positionable within arm's reach of the seated user and is actuatable using a single hand.

According to another implementation, a stool for dentistry comprises a leg assembly with multiple feet, a seat assembly supported by the leg assembly and having a seat, a height adjusting mechanism having a support member coupleable to the stool adjacent the seat, a movable height adjusting assembly that is selectively movable up and down relative to the support member and an actuator positionable on a side of the movable height adjusting assembly adjacent a seated user. The actuator can be manually actuatable by the seated user to release the movable height adjusting assembly from a locked position at a current height to move the movable height adjusting assembly to a new height, e.g., to change a height of a seat back (and/or a torso bar) positioned at a distal end of the height adjusting mechanism.

The stool can include an optional tilt mechanism configured to permit the support member to selectively tilt relative to the seat assembly in response to force from a seated user. The stool can include optional arm rests that are height adjustable and pivotable.

The foregoing and other features and advantages of the disclosed embodiments will become more apparent from the following detailed description, which proceeds with reference to the accompanying figures.

DETAILED DESCRIPTION

Figure 1A:
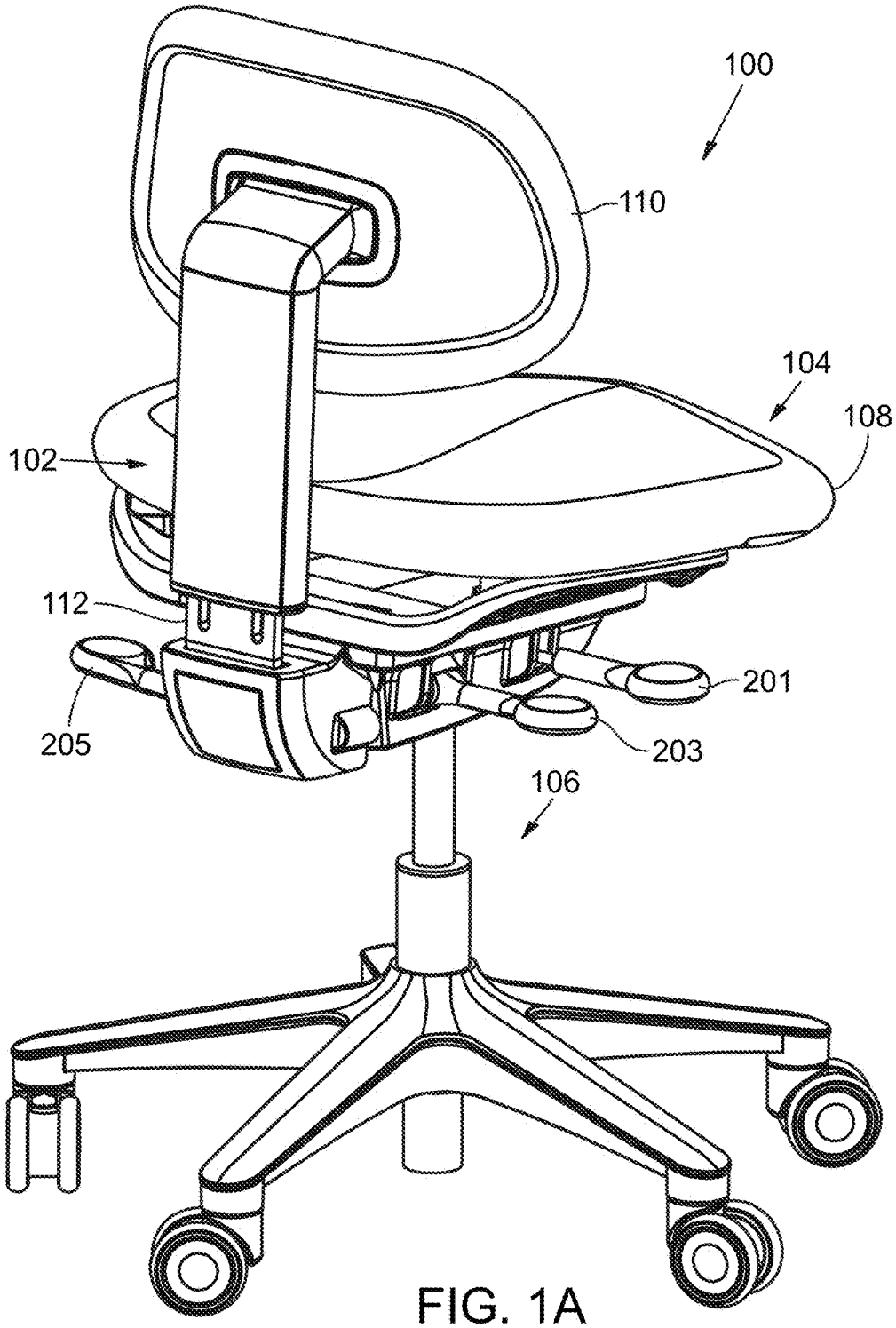
FIGS. 1A and 1B are perspective views of a practitioner's stool according to a first implementation.
Figure 1B:
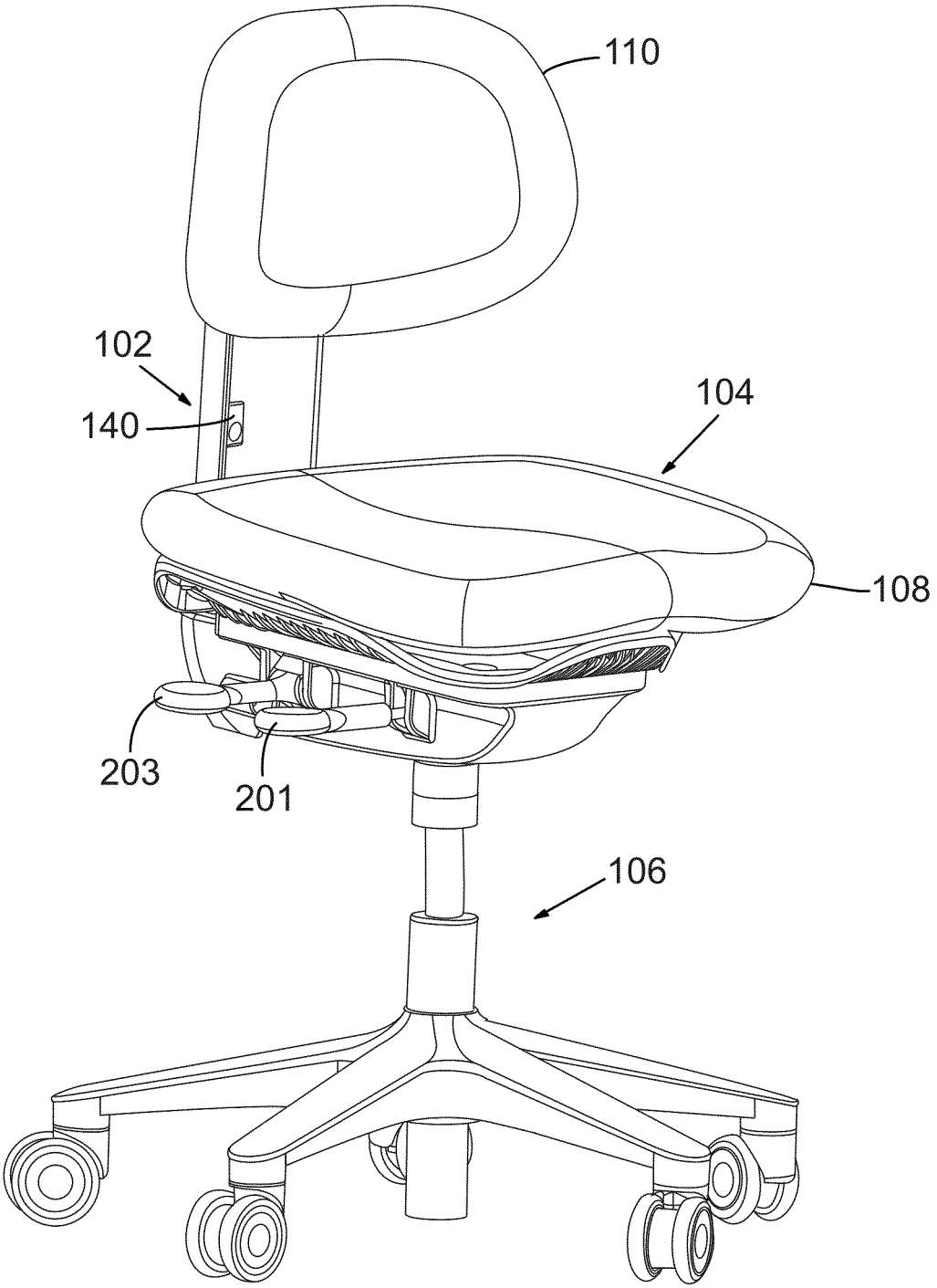

FIGS. 1A and 1B are perspective views from different sides of an embodiment of a practitioner stool 100. The stool 100 has a seat back assembly 102, which extends from a seat assembly 104. The seat back assembly 102 and the seat assembly 104 are supported by the leg assembly 106. As shown, the leg assembly 106 has a center support from which multiple legs with casters extend.

The seat assembly 104 includes a seat 108 shaped to support a practitioner in a seated position. The seat back assembly 102 is adjustable to change a height of a seat back 110 coupled to its upper end. At a lower end, the seat back assembly 102 has a support 112 (also referred to as a support member) that is connected to a rear area of the seat assembly 104.

Figure 2A:
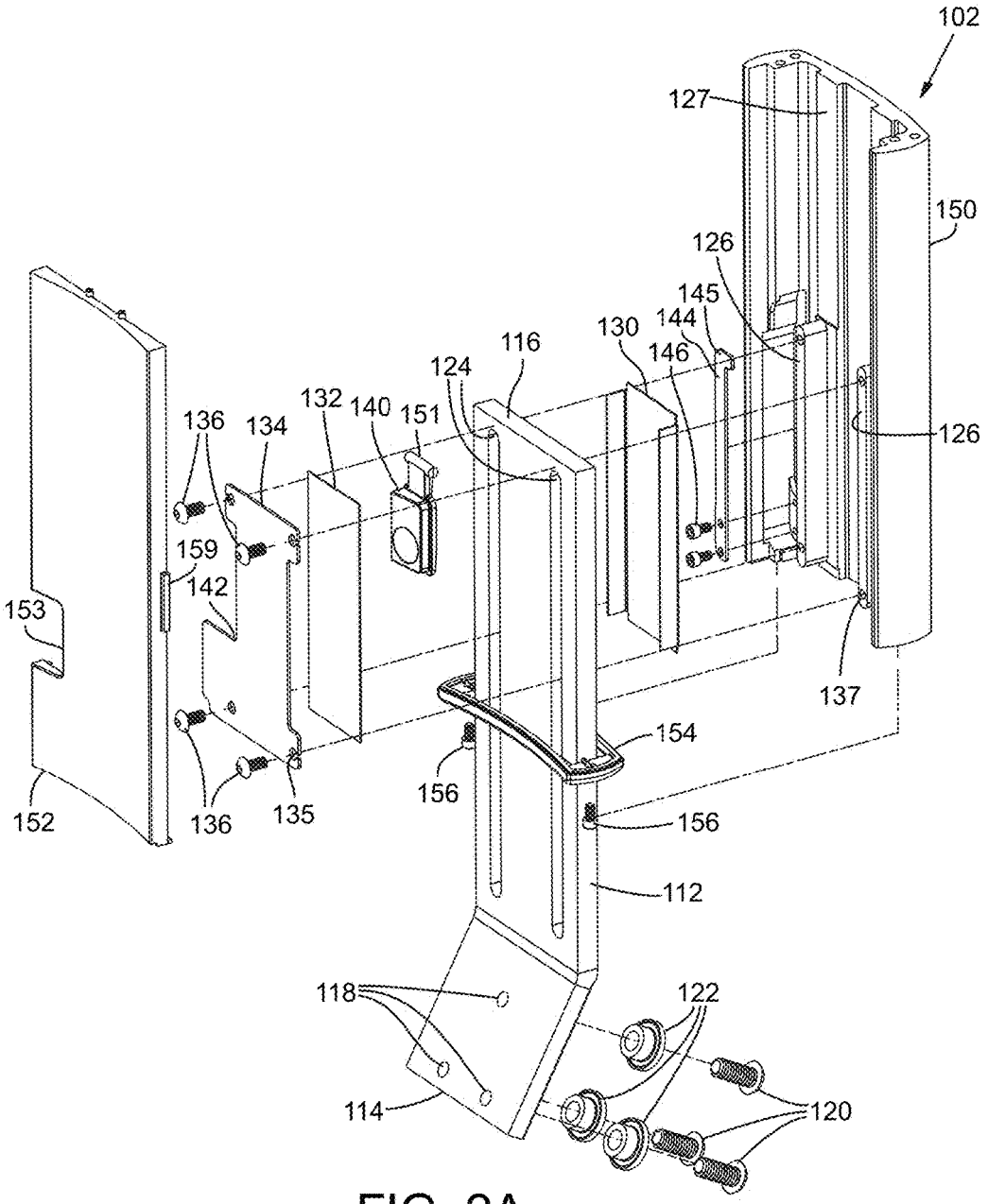
FIG. 2A is an exploded perspective view of an adjustment assembly for changing a height of a seat back on the stool of FIG. 1.

FIG. 2A is an exploded perspective view of an embodiment of the seat back assembly 102, which is also referred to herein as a height adjust mechanism. As shown in FIG. 2, the support 112 in the illustrated implementation has a lower end 114 and an opposite upper end 116. The lower end 114 can have apertures 118 for receiving fasteners 120 to secure the support 112 in place. In the illustrated implementation, there are optional spacers 122 through which the fasteners 120 are threaded. The lower end 114 can be angled as shown to suit the particular configuration, or it may have another suitable shape. As is described in more detail below, a movable portion, or movable height adjusting assembly, is movable relative to the support 112 which is stationary (unless provided with an optional tilt capability, as is described below).

The support 112 includes at least one generally upright guiding feature, such as one or more guide grooves or slots. In the illustrated implementation, the support 112 includes a pair of parallel through slots 124 configured to be positioned generally vertically when assembled. The support 112 is constructed to have a robust configuration that does not yield. In some implementations, the support 112 is machined from solid bar stock steel.

The slots 124 receive guide members, which in the illustrated implementation are the respective guide members 126 extending from an inner surface 127 of an outer cover 150. Each guide member 126 has a lateral width shaped to be slidingly received in one of the slots 124, respectively, and a substantial length so as to ensure that the movable assembly can be extended and retracted smoothly without excess play. The guide members 126 are secured in the respective slots 124 by a plate 134 on an inner side, which is secured by fasteners 136 that extend through apertures 135 and are received in threaded holes or bores 137 in the guide members 126. In the illustrated implementation, there are two fasteners 136 securing the left side of the clamp plate 134 to a left guide member 126. There are also two fasteners 136 securing a right side of the clamp plate 134 to a right guide member 126, but the right side of the clamp plate 134 has a cut-out or opening 142 shaped to receive an actuator 140 accessible from an exterior surface of the seat back assembly 102 (see, e.g., FIG. 1) that the user can depress or otherwise manually actuate to allow the user to adjust the position of the seat back 110, i.e., to move it upward or downward. In some implementations, the actuator 140 is a pushbutton actuator.

Figure 2B:
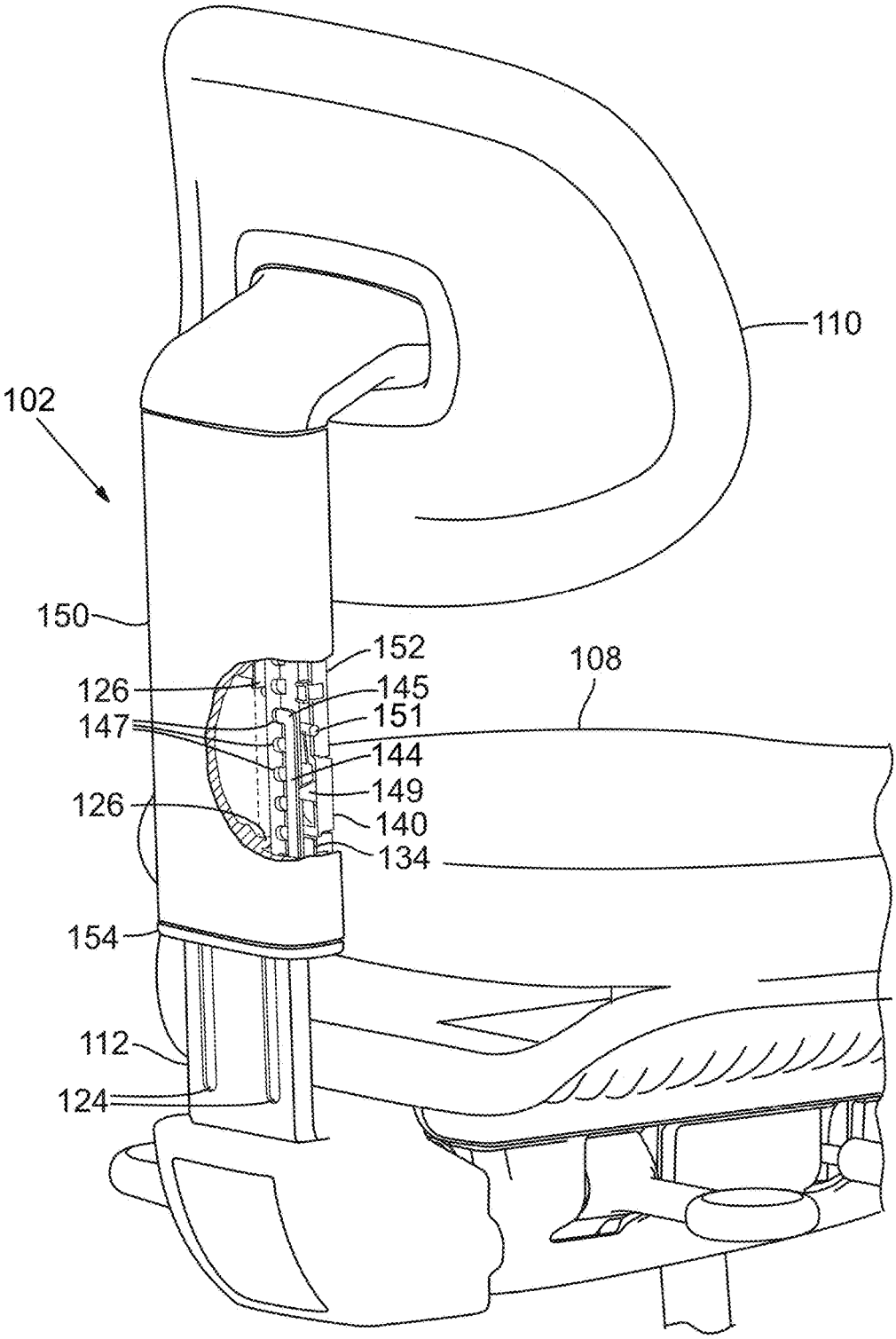
FIG. 2B is an enlarged perspective view showing part of the stool of FIG. 1 with portions of the adjustment assembly cutaway to show its internal components.
Figure 3C:
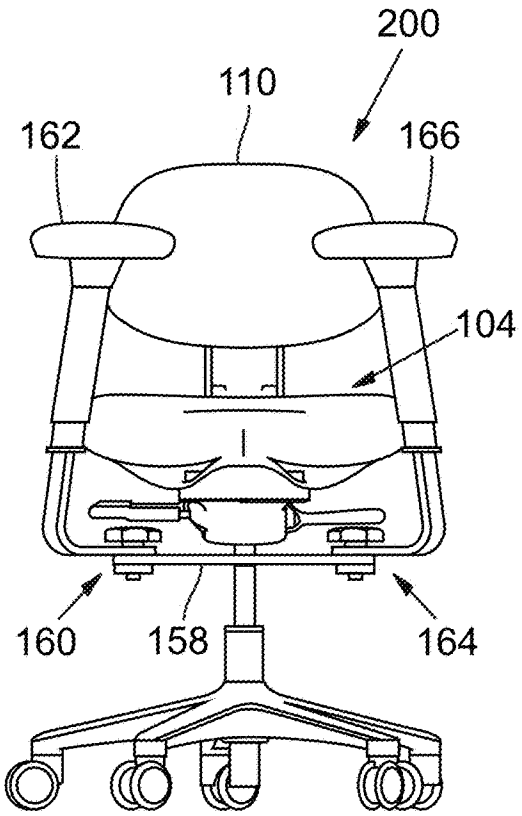
FIGS. 3A-3C are front elevation views of a stool similar to the stool of FIG. 1, but having adjustable armrest assemblies and armrests.
Figure 3B:
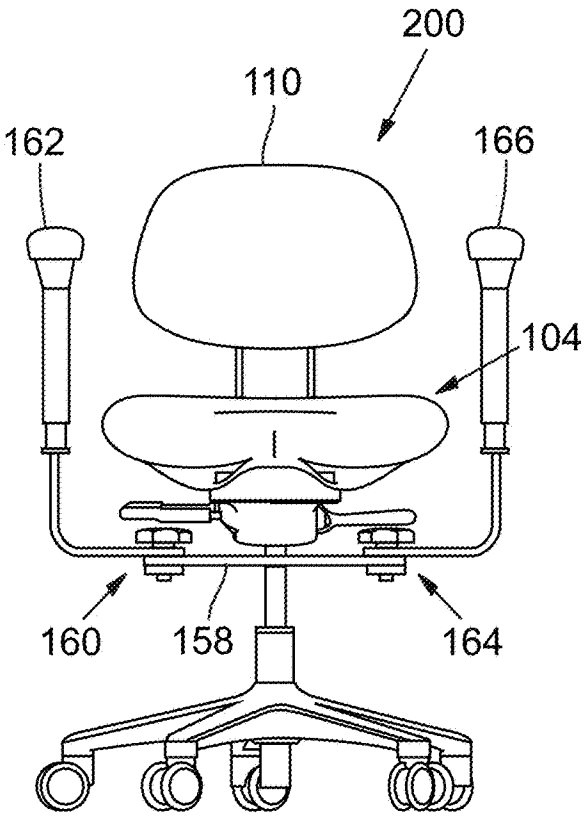
Figure 3A:
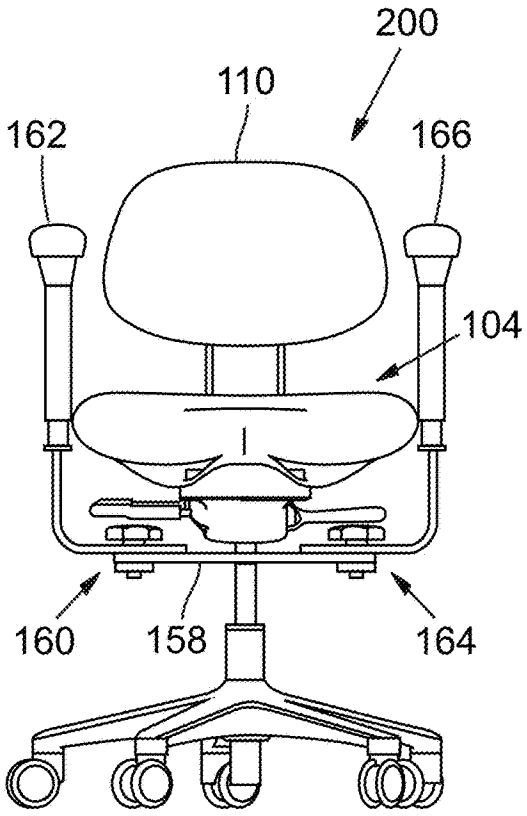

FIG. 2B is a perspective view of the seat back assembly 102 from a rear side with a portion of the outer cover 150 cut away to show the interaction of the guide members 126 in the slots 124 and an engagement member 144. As illustrated, a distal end 145 of the engagement member 144 is positioned into one of a series of spaced recesses 147 formed in the support 112, such as by being spring-biased in a direction towards the support 112. The spaced recesses 147 define a height adjustment range for the seatback 110. In the illustrated implementation, the engagement member 144 is attached at its lower end to the inner surface 127 with fasteners 146 (FIG. 2A).

When the actuator 140 is depressed with sufficient force, a projection 149 on the actuator contacts the engagement member 144 and moves the distal end 145 away from the support 112 and out of engagement with the recess 147. While the distal end is disengaged, the user can adjust the height of the seat back 110 by grasping the movable assembly (formed by the outer cover 150, a mating inner cover 152 and the other associated components coupled thereto) and sliding it upward or downward relative to the support 112 to a new position. Conveniently, the user can reach behind with a right hand, depress the actuator 140 with a thumb, and at the same time use the other four fingers to grasp and move the movable subassembly. Thus, it is possible to adjust the height of the seat back using one hand, which is advantageous, particularly in working environments where frequent changes in seating positions are desirable.

As shown in FIGS. 1B and 2B, the actuator 140 can be positioned against the inner cover 152 with a mount 150 held in place to permit the actuator to pivot when depressed. As shown in FIG. 2A, optional wear pads 130, 132 can be assembled in contact with the outer and inner surfaces of the support 112. The wear pads, which can made of a nylon plastic or other similar material, can be provided to make components of the movable subassembly slide more freely relative to the support 112 and to minimize wear from repeated use.

When the actuator 140 is in its at rest position, the engagement between the distal end 145 and the selected one of the recesses 147 provides sufficient force to keep the seatback 110 in place and prevent unwanted movement. Of course, other suitable arrangements to provide suitable engagement and/or clamping forces can be used. The height range and adjustment increment are set to accommodate users of a wide range of heights and sizes, as well as to accommodate users' different positions on the stool, including a regular seated position and other positions a practitioner might adopt while working that would cause the practitioner to contact some portion of the seat back assembly 102.

As shown in FIG. 2A, a lower cover 154 can be provided, and it can be secured in place, such as to the outer cover 150 as shown, with fasteners 156. The outer cover 150 can be formed of extruded aluminum, or another suitable material. The inner cover 152 and the lower cover 154 can be formed of injection molded plastic, such as an injection molded polyester and polycarbonate blend, or another suitable material. The inner cover 152 may have a tab 159 or other feature to assist in aligning it with the outer cover 150.

As can be seen in FIGS. 1A, 1B, 2B, 3A-3C, the seat back assembly 102 (as well as the related assembly 102' discussed below) has an exterior configuration that features surfaces that are generally smooth, few if any sharp corners and substantial generally planar areas. As a result, the actuator 140 can be situated as shown on a forward surface of the assembly adjacent a seat practitioner's back. This positioning has been found to allow the practitioner to reach back, such as with his or her right hand, to locate the actuator without needing to view it, and to depress it while grasping the surrounding structure, i.e, the relatively smooth and uninterrupted surfaces of the inner cover 152 and the outer cover 150. In addition, the smooth surfaces of the seat back assembly that are relatively free of interruptions allow for the stool to be cleaned effectively and easily, which is a necessary requirement for the dental operatory environment.

Figure 7:
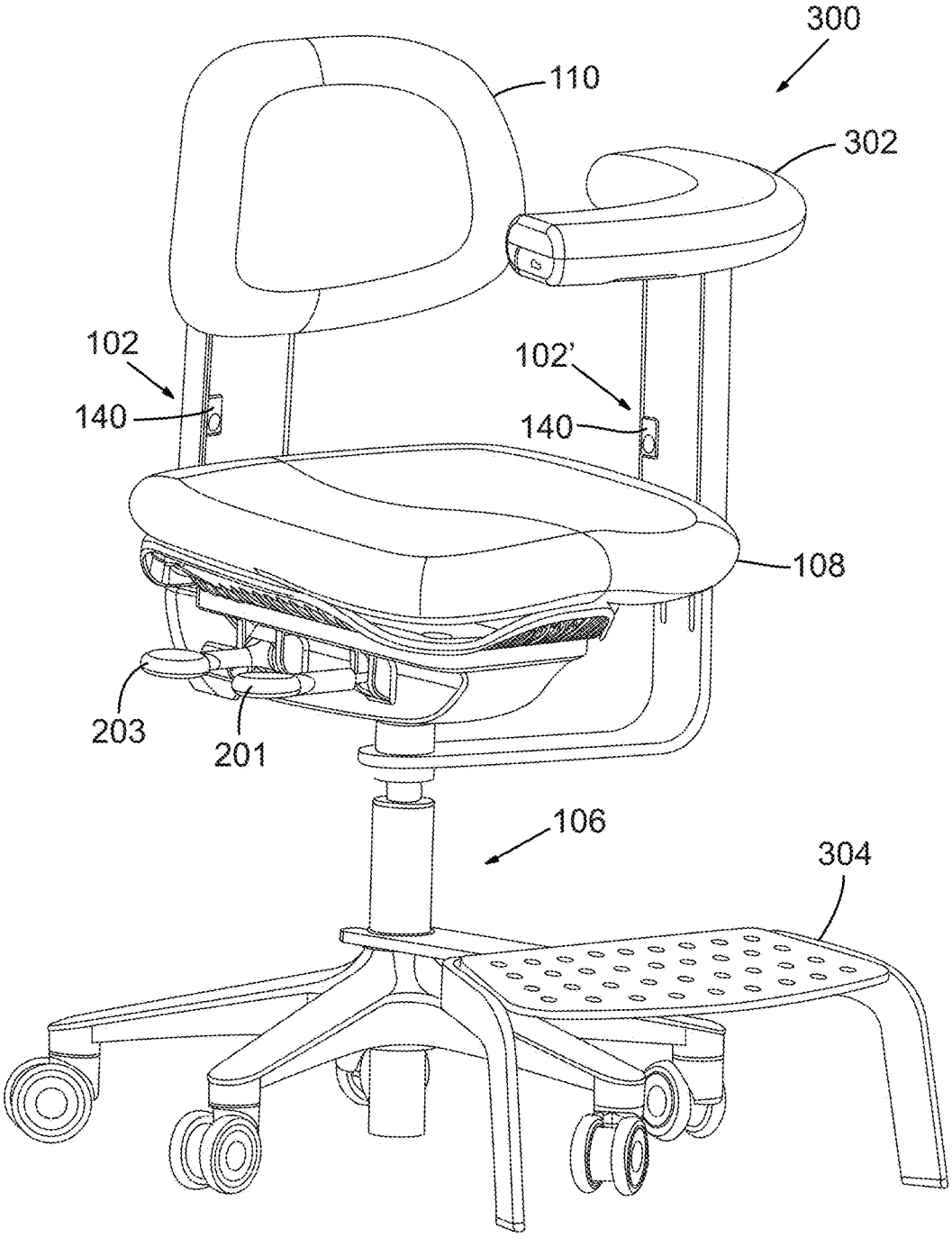
FIG. 7 is a perspective view of a stool according to another implementation.

Although described as a height adjustment mechanism for adjusting the height of the seat back 110, the same components can be configured for other adjusting functions. For example, as shown in FIG. 7 for an assistant's stool 300, the same assembly as the seat back assembly 102 can be implemented as a torso bar assembly 102' to allow a height of a torso bar 302 to be adjusted upward or downward relative to the seat 108. This allows an assistant or other occupant to adjust the torso bar 302 for a proper height relative to the assistant's size and current activity, which may require leaning over the torso bar 302 to access a patient's oral cavity. The assistant's stool 300 is generally similar to the stool 100, which allows common components to be used interchangeably. As illustrated, the stool 300 is fitted with an optional, rotatable foot rest 304 that is useful to support the user's feet when the stool 300 is used at greater heights.

Figure 4:
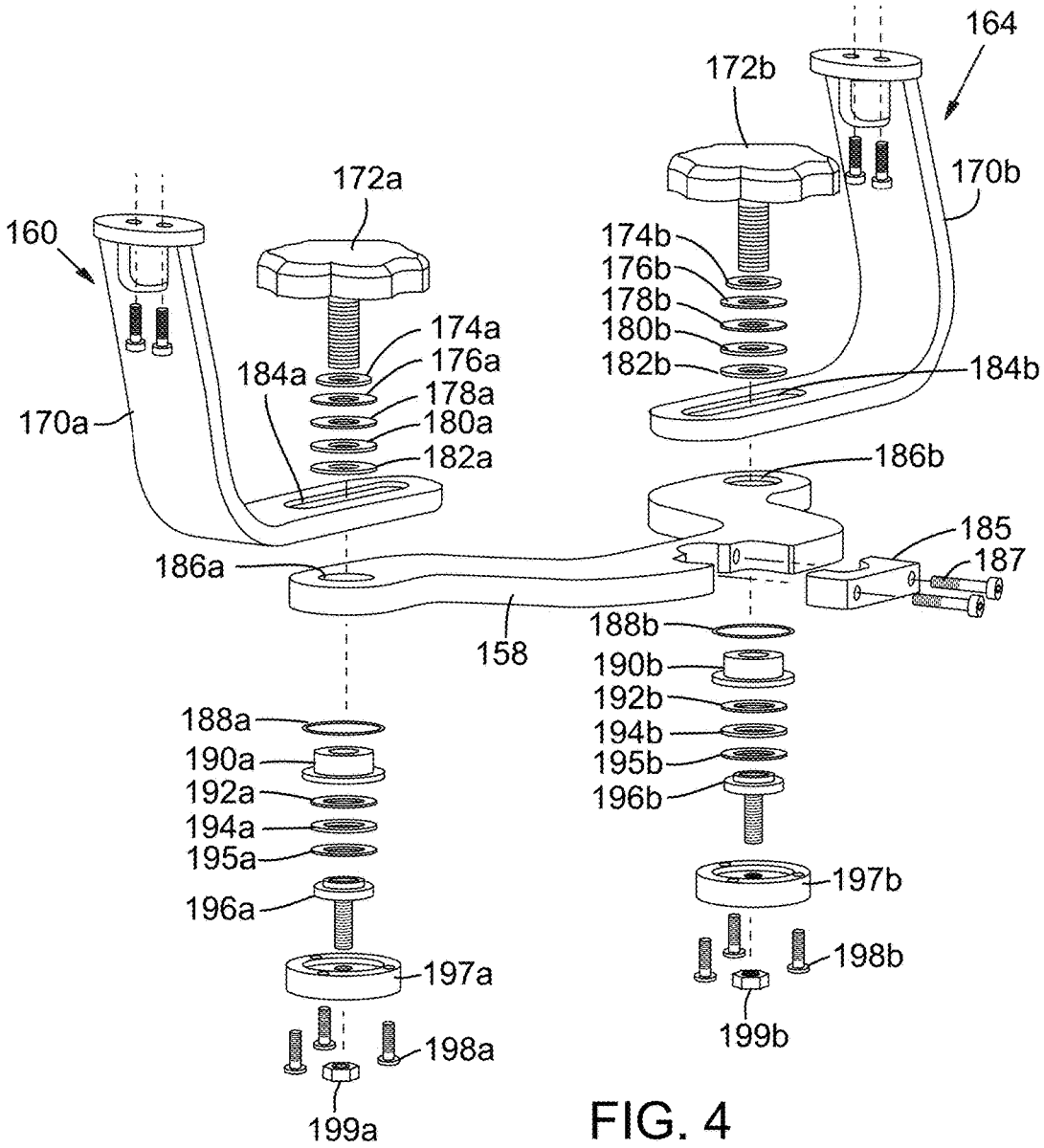
FIG. 4 is an exploded perspective view of a portion of the adjustable armrest assemblies.
Figure 5:
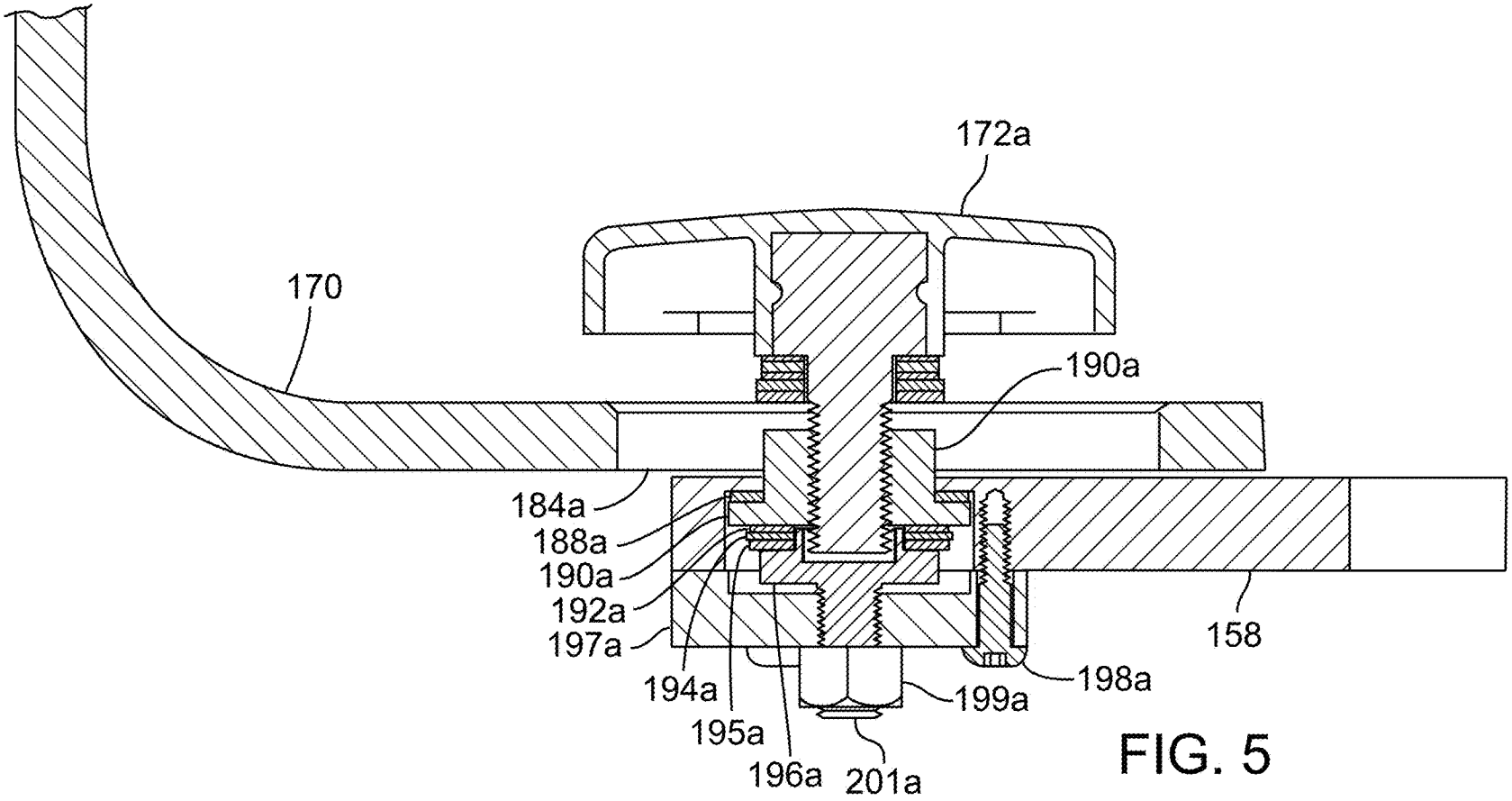
FIG. 5 is an enlarged section view in elevation of a portion of one adjustable armrest assembly of FIG. 4.
Figure 6A:
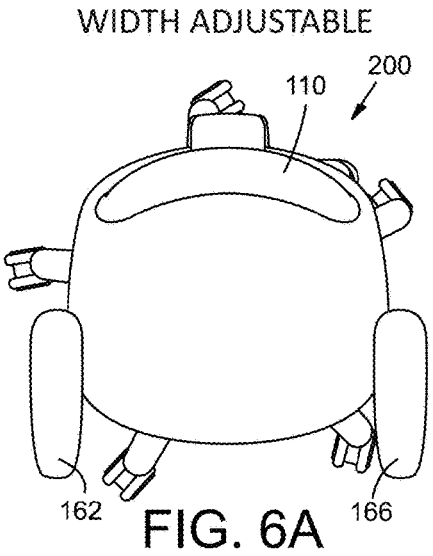
FIGS. 6A-6D are schematic plan views of a stool having two adjustable armrest assemblies and showing various positions in which the armrests can be positioned relative to each other and the rest of the stool.
Figure 6B:
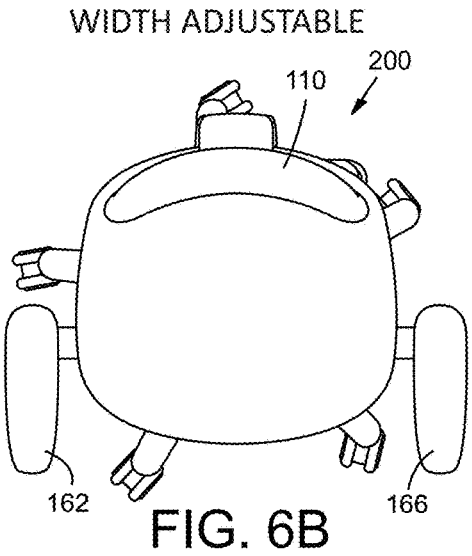
Figure 6C:
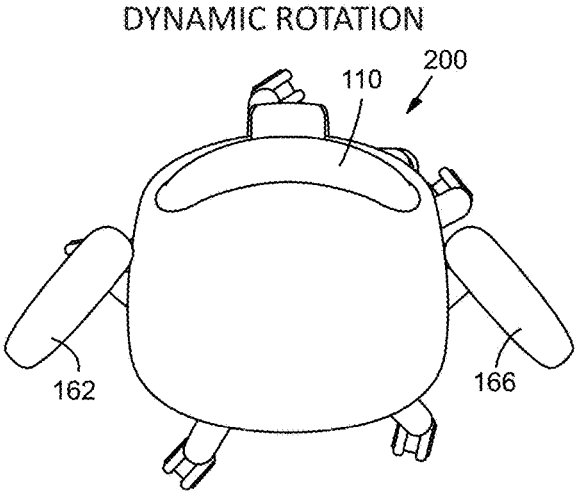
Figure 6D:
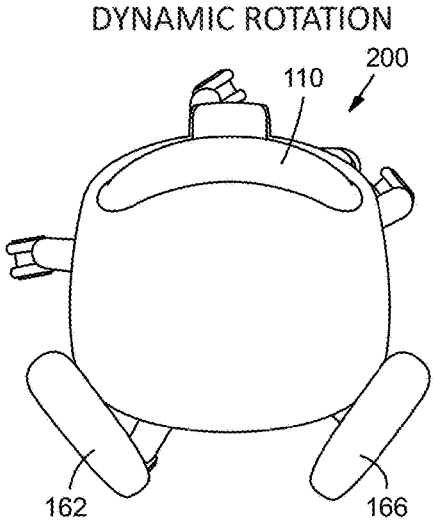

According to another implementation as shown in FIGS. 3A-6D, a stool 200 has adjustable armrests, such as a right armrest assembly 160 for supporting a right armrest 162 and a left armrest assembly 164 for supporting a left armrest 166 (for convenience, "left" and "right" as used herein refer the seated occupant's left and right). The armrest assemblies 160, 164 are capable of multiple movements to allow the armrests 162, 166 to be independently positioned in a wide variety of positions. Referring to the front side elevation view of FIG. 3A, the armrests 162, 166 are shown in a regular width position. FIG. 6A is a plan view of the chair 200 with the armrests 162, 166 in the regular width position. In FIG. 3B, the armrests 162, 166 have been moved to a wide position by adjusting each respective armrest assembly 160, 164 relative to an armrest base 158, as is described in detail below. FIG. 6B is a plan view of the chair 200 with the armrests 162, 166 in the wide position. In FIG. 3C, the armrests 162, 166 have been rotated inwardly to a narrow, elbow support position in which the user can conveniently place his or her elbows on the armrests 162, 166. FIG. 6D is a plan view of the chair 200 with the armrests 162, 166 rotated to the elbow support position. FIG. 6C is a plan view of the chair 200 with the armrests 162, 166 rotated to a spread position, which can be used to move the armrests out of the way for the user's specific activities, as well as ingress and/or egress.

FIG. 4 is an exploded perspective view of the armrest assembly 160, the armrest assembly 164 and the armrest base 158, showing the components that allow the relative movements necessary to permit the armrests 160, 166 to be positioned in a wide range of positions. FIG. 5 is a sectioned elevation view of the armrest assembly 160 for the right side showing the components in an assembled state.

Referring to FIGS. 4 and 5, the armrest assembly 160 has an adjustment knob 172*a* with a shaft that extends through a slot 184*a* in a support member 170*a* that supports the armrest 162 and through an aligned opening 186*a* in the armrest base 158. The distal end of the shaft is received in a pivot hub 190*a*. A backer plate 197*a* is secured to a lower side of the armrest base with fasteners 198*a*. There is a friction adjustment screw 196*a* with a threaded end extending outwardly through the backer plate 197*a* that receives a nut 199*a* for adjusting the amount of friction experienced during movements. If necessary, the friction adjustment screw 196*a* can be held in place while the nut 199*a* is rotated by inserting an appropriate tool in a slot or recess provided at an end 201*a* of the friction screw 196*a*.

In the illustrated implementation, there is a series of components positioned between the adjustment knob 172*a* and the armrest base 158, namely a thrust washer 174*a*, a thrust bearing 176*a*, a thrust washer 178*a*, a low friction (e.g., nylon plastic) washer 180*a* and another low friction (e.g., nylon plastic) washer 182*a*. Similarly, there are similar components in the assembly below the armrest base 158, including a friction washer 188*a* positioned over the pivot hub 190*a*, and a friction isolation bearing stack comprising a thrust washer 192*a*, a thrust bearing 194*a* and a thrust washer 195*a* positioned between the pivot hub 190*a* and the friction adjustment screw 196*a*. A slight gap is maintained between the support member 170*a* and the armrest base 158.

The bearings, hub, washers and friction components provide for smooth pivoting and an adjustable degree of friction to prevent unintended rotation of the armrests. Desirably, a range of friction is possible, including sufficient friction to keep the armrests in position after only incidental contact, but allowing the armrest to be moved freely, without manipulation of other components, when pushed or pulled. This provides users with a positive fee for how components of the stool move relative to each other.

The adjustment knob 172*a* can be tightened to keep the armrest 162 at any desired position. The armrest assembly 164 is a mirror image of the armrest assembly 160. A yoke 185 and fasteners 187 are used to secure the arm base 158 to part of the chair, such as, e.g., a shaft of the chair.

The stool can include one or more manual controls, e.g., the levers (or paddles) 201, 203 and/or 205, to allow the user to adjust the positions of portions of the stool. For example, the leg assembly 106 that supports the seat 108 may include a gas cylinder controllable with the lever 201 to assist the user in raising or lowering the seat 108 to a desired height. As another example, the lever 203 may be configured to actuate a tilt adjust mechanism to permit the seat 108 and back 110 to be angled in unison under tension (such as when a seated user leans against it them), to change the tension and/or to lock the seat 108 and back 110 in place and prevent any tilting. The lever 205 may be configured to permit the back 110 to be reclined relative to the seat 108.

Commonly assigned and concurrently filed applications entitled "SEAT ASSEMBLY FOR TASK-ORIENTED SEATING" (U.S. Patent Application No. NOT YET ASSIGNED) and "ARMREST ASSEMBLY AND STOOL FOR DENTAL PRACTITIONER" (U.S. Patent Application No. NOT YET ASSIGNED) are incorporated herein by reference.

In view of the many possible embodiments to which the disclosed principles may be applied, it should be recognized that the illustrated embodiments are only preferred examples and should not be taken as limiting the scope of protection. Rather, the scope of protection is defined by the following claims. We therefore claim all that comes within the scope of these claims.

We claim:

1. A height adjusting mechanism for a dentistry stool, comprising:

a support member coupleable to the stool adjacent an aft side of a seat of the stool, the support member having at least one guide groove;

a movable height adjusting assembly that is selectively movable up and down relative to the support member, the movable height assembly having a front cover and a rear cover that substantially enclose corresponding front and rear engaged portions of the support member, wherein at least one of the front cover and the rear cover comprises an inner surface with protruding guide members configured to engage the guide groove in the support member; and a pushbutton actuator positionable in a cutout on a front side of the movable height adjusting assembly adjacent a seated user, the pushbutton actuator being manually actuatable by the seated user to release the movable height adjusting assembly from a locked position at a current height to allow the seated user to move the movable height adjusting assembly to a new height.

2. The height adjusting mechanism of claim 1, further comprising a seat back, wherein the seat back is coupled to a distal end of the movable height adjusting assembly.

3. The height adjusting mechanism of claim 2, wherein, when assembled, the seat back is spaced along a horizontal fore-aft axis farther from the aft side of the seat than the movable height adjusting assembly and support member.

4. The height adjusting mechanism of claim 1, further comprising a torso bar, wherein the torso bar is coupled to a distal end of the movable height adjusting assembly.

5. The height adjusting mechanism of claim 1, wherein the support member has an angled proximal end with apertures, and wherein the angled proximal end is configured for coupling the support member rearward of a seat of the stool.

6. The height adjusting mechanism of claim 1, wherein the pushbutton actuator is positionable within arm's reach of the seated user and is actuatable using a single hand.

7. A height adjusting mechanism for a dentistry stool, comprising:

a support member coupleable to the stool adjacent an aft side of a seat of the stool;

a movable height adjusting assembly that is selectively movable up and down relative to the support member, the movable height assembly having a front cover and a rear cover that substantially enclose corresponding front and rear engaged portions of the support member, wherein the rear cover has a U-shaped cross section, and wherein the front cover is configured to fit within the U-shaped cross section; and a pushbutton actuator positionable in a cutout on a front side of the movable height adjusting assembly adjacent a seated user, the pushbutton actuator being manually actuatable by the seated user to release the movable height adjusting assembly from a locked position at a current height to allow the seated user to move the movable height adjusting assembly to a new height.

8. A height adjusting mechanism for a dentistry stool, comprising:

a support member coupleable to the stool adjacent an aft side of a seat of the stool;

a movable height adjusting assembly that is selectively movable up and down relative to the support member, the movable height assembly having a front cover and a rear cover that substantially enclose corresponding front and rear engaged portions of the support member, further comprising a lower cover with an opening shaped to receive the support member, the lower cover being configured for positioning at a junction of the rear cover and the front cover adjacent their proximal ends;

a pushbutton actuator positionable in a cutout on a front side of the movable height adjusting assembly adjacent a seated user, the pushbutton actuator being manually actuatable by the seated user to release the movable height adjusting assembly from a locked position at a current height to allow the seated user to move the movable height adjusting assembly to a new height.

9. The height adjusting mechanism of claim 1, wherein the pushbutton actuator comprises a biased engagement member coupled to an inner surface of the movable height adjusting assembly.

10. The height adjusting mechanism of claim 9, wherein the front cover and the rear cover having smooth outer surfaces to facilitate cleaning.

11. The height adjusting mechanism of claim 9, wherein the biased engagement member is coupled to the rear portion.

12. The height adjusting mechanism of claim 9, wherein the support member comprises a series of spaced recesses, and wherein the engagement member is biased to contact one of the recesses.

13. The height adjusting mechanism of claim 9, further comprising a plate configured to be coupled to the rear portion with the support member positioned between the plate and the rear portion.

* * * * *